US006026620A

United States Patent [19]

Spude

[11] Patent Number: 6,026,620

[45] **Date of Patent: *Feb. 22, 2000**

[54] FOUNDATION CONSTRUCTION SYSTEM

[76] Inventor: Gerald T. Spude, 6628 Westslope La., Oconto, Wis. 54153

[ * ] Notice: This patent is subject to a terminal disclaimer.

[21] Appl. No.: 09/158,229

[22] Filed: Sep. 22, 1998

Related U.S. Application Data

[63] Continuation of application No. 08/700,812, Aug. 21, 1996, Pat. No. 5,809,726.

[51] Int. Cl.[7] ..... F04B 1/99

[52] U.S. Cl. ..... 52/275; 52/276; 52/278; 52/279

[58] Field of Search ..... 52/275, 276, 278, 52/279, 562, 568, 426

[56] References Cited

U.S. PATENT DOCUMENTS

| | | | |
|---|---|---|---|
| 1,738,842 | 12/1929 | Ray | 52/275 |
| 2,339,220 | 1/1944 | Crowley | 52/275 |
| 3,293,813 | 12/1966 | Emmons et al. | 52/238 |
| 3,423,891 | 1/1969 | Burris | 52/275 X |
| 3,508,364 | 4/1970 | Thompson | 52/275 X |
| 3,713,257 | 1/1973 | Beavers | 52/36 |
| 4,368,604 | 1/1983 | Spielau et al. | 52/591.1 X |
| 4,433,520 | 2/1984 | Maschhoff | 52/275 |
| 4,633,634 | 1/1987 | Nemmer et al. | 52/275 X |
| 4,742,665 | 5/1988 | Baierl | 52/276 |
| 4,796,727 | 1/1989 | Schmaling | 52/591.1 X |
| 5,618,602 | 4/1997 | Nelson | 52/591.1 X |
| 5,809,726 | 9/1998 | Spude | 52/562 X |

*Primary Examiner*—Carl D. Friedman
*Assistant Examiner*—Phi Dieu Tran A
*Attorney, Agent, or Firm*—Michael Best & Friedrich LLP

[57] ABSTRACT

A building system and apparatus for forming a wall on a footing. U-shaped channels and H-shaped or T-shaped members coupled at their sides by rigid links hold foam panels in a desired spaced relationship. Vertically oriented panels aligned and connected by T-shaped members or horizontally oriented panels stacked with and connected by H-shaped members are inserted into the U-shaped channels to form a structure of the desired length. Concrete is poured between the panels and members where it hardens to form a structural wall. The planar surfaces of the U-shaped, H-shaped and T-shaped members enable the members to be extruded, thereby substantially reducing member production costs. Furthermore, widely available conventional foam panels can be used, reducing panel production costs.

37 Claims, 19 Drawing Sheets

FOUNDATION CONSTRUCTION SYSTEM

This application is a continuation of application Ser. No. 08/700,812 filed on Aug. 21, 1996 now U.S. Pat. No. 5,809,726.

BACKGROUND OF THE INVENTION

This invention relates generally to building construction form systems and, more particularly, to building construction form systems for forming foundations and the like.

Concrete foundations have typically been constructed using expensive reusable forms. These forms have typically been heavy and extremely labor-intensive to assemble. Various other form systems have been proposed to reduce construction expense. These systems typically reduce labor costs and expense through the use of light and inexpensive materials that can be left in place after concrete or other building materials are poured into the form system.

Although effective, these alternate systems are not without drawbacks. Typically, these designs require parts that are formed by injection molding, which is an expensive process requiring expensive tooling. Injection molding has also limited the practical length of the parts that can be produced to around nine feet. These relatively short lengths increase labor costs by increasing the number of connections required in the assembly process.

Previous designs have generally required complex shapes and relatively complex assembly procedures. This complexity increased training costs and decreased efficiency while workers learned to use the system. Further, this complexity increased tooling costs.

Leveling the top of the form has also been difficult and labor-intensive with previous designs. It is critical to have a level foundation upon which to build, yet prior art designs have generally not provided a convenient way of achieving a level configuration.

Another important design criterion concerns connection to abutting pieces and the ability to form corners without requiring complex pieces produced by labor-intensive operations. Previous designs have necessitated the use of special pieces which increase tooling costs and increase the complexity of the design. Further, appropriate inventories of each of the pieces had to be accurately established to avoid costly delays midway through the project as more pieces of a certain type were purchased and transported to the job site.

It is therefore an object of the present invention to provide a novel building form system and apparatus.

It is a further object of the present invention to provide an improved form system and apparatus that provides attachment surfaces to which drywall can be coupled to meet existing building code requirements.

It is a further object of the invention to provide a form system that is easy to use and that reduces training costs by eliminating numerous special use pieces required by many previous designs.

It is yet another object of the invention to reduce time and effort required to set up a building form system by eliminating the need for scaffolding or other above ground framework for erection of form systems of substantial height.

It is a further object of the invention to provide a novel building form method and apparatus using substantially vertically oriented support members that perform both panel retention and system reinforcement functions.

It is a further object of the invention to eliminate complex exterior bracing formerly necessary to prevent the form system from bulging as liquid building material is poured into the system.

It is a further object of another preferred embodiment of the invention to provide a novel method of erecting a substantially vertically oriented form system and apparatus by installing panels and support members individually from ground level along tracks provided by the invention.

It is a further object of another preferred embodiment of the invention to provide an improved method of installing a component between interior and exterior panel alignments of the form system, without the need to disassemble the form system, by raising an individual panel vertically from the ground level.

SUMMARY OF THE INVENTION

The invention provides a building form system and apparatus including T-shaped and U-shaped lengths of extruded plastic or steel coupled at their sides by rigid links. The links are preferably coupled at ninety degree angles along the lengths of the T-shaped and U-shaped elongated members. The T-shaped members are erected in a substantially vertical orientation and the bottom edges of the T-shaped members are inserted into channels of the U-shaped members. The bottom edges of panels, such as polystyrene boards, are inserted in channels in the U-shaped lengths to retain the panels in a spaced-apart relationship and a vertical orientation. This spacing enables flow of hardenable liquid building material e.g. concrete) between the panels and the T-shaped and U-shaped elongated members. The panels are connected laterally using the T-shaped members, the flanges of which are inserted into milled slots in the lateral edges of the panels.

In one alternative embodiment of the invention, substantially vertically oriented H-shaped elongated members are substituted for the T shaped members. The panels can be aligned and connected by inserting the flanges of the H-shaped member into milled slots in the lateral edges of the panels. The T-shaped or H-shaped members and panels are available in (or can be cut to) various lengths to create a structure of desired height. The vertical orientation of the T-shaped or H-shaped members also acts as a load bearing system once the liquid building material has hardened, increasing the load bearing strength of the wall.

Another preferred embodiment of the invention provides a building form system and apparatus including H-shaped and U-shaped lengths of extruded plastic or steel coupled at their sides by rigid links. The links are coupled at ninety degree angles along the lengths of the H-shaped and U-shaped elongated members. Panels, such as polystyrene boards, are received in channels in the H-shaped and U-shaped lengths to retain the wall panels in a spaced-apart relationship. This spacing enables flow of hardenable liquid building material (e.g., concrete) between the panels and the H-shaped and U-shaped elongated members. The panels and H-shaped lengths can be stacked upon each other to create a structure of desired height.

In all the aforementioned embodiments, the T-shaped, H-shaped and U-shaped lengths enable coupling of drywall and other building materials to the assembly formed by the T-shaped, H-shaped and U-shaped elongated members, the links, the panels and the hardened building material. The links prevent compression or expansion of the form system so that the resulting structure is of the desired dimension.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

FIG. 16A illustrates the coupling of an corner post to a substantially vertically oriented panel using a substantially vertically oriented T-shaped member. FIG. 16B illustrates the coupling of two vertically oriented T-shaped members coupled using substantially rigid links to the panel. FIG. 16C illustrates the coupling of a second substantially vertically oriented panel perpendicular to the first said panel using a T-shaped member. FIG. 16D illustrates the coupling of a preformed corner panel to the interior T-shaped member described in FIG. 16B. FIG. 16E illustrates the coupling of the preformed corner panel described in FIG. 16D to the panel described in FIG. 16C using two substantially vertically oriented T-shaped members coupled with substantially rigid links.

DETAILED DESCRIPTION OF PREFERRED EMBODIMENTS

Figure 1:
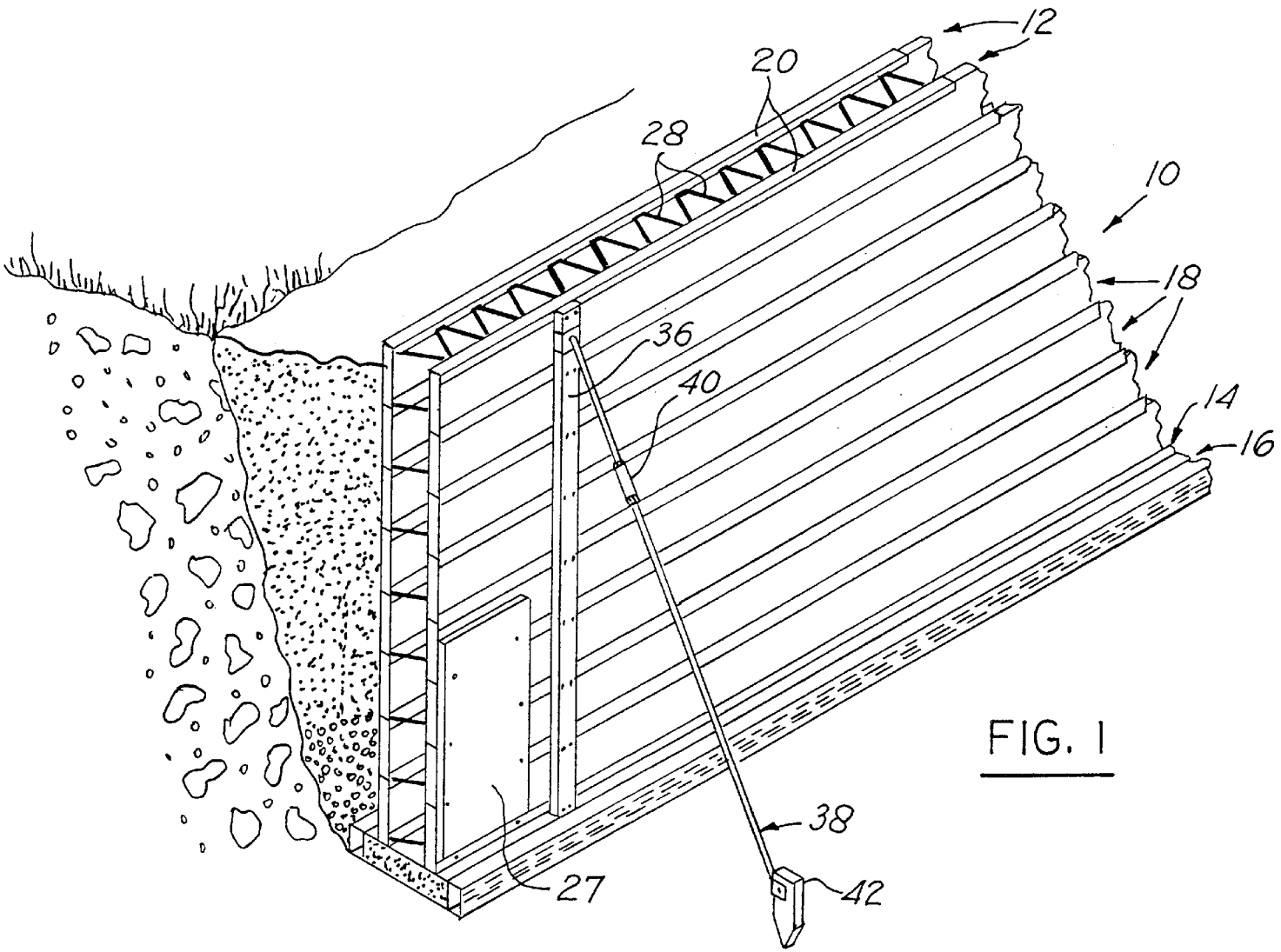
FIG. 1 is a perspective view of a form system and apparatus constructed in accordance with one form of the invention.
Figure 2:
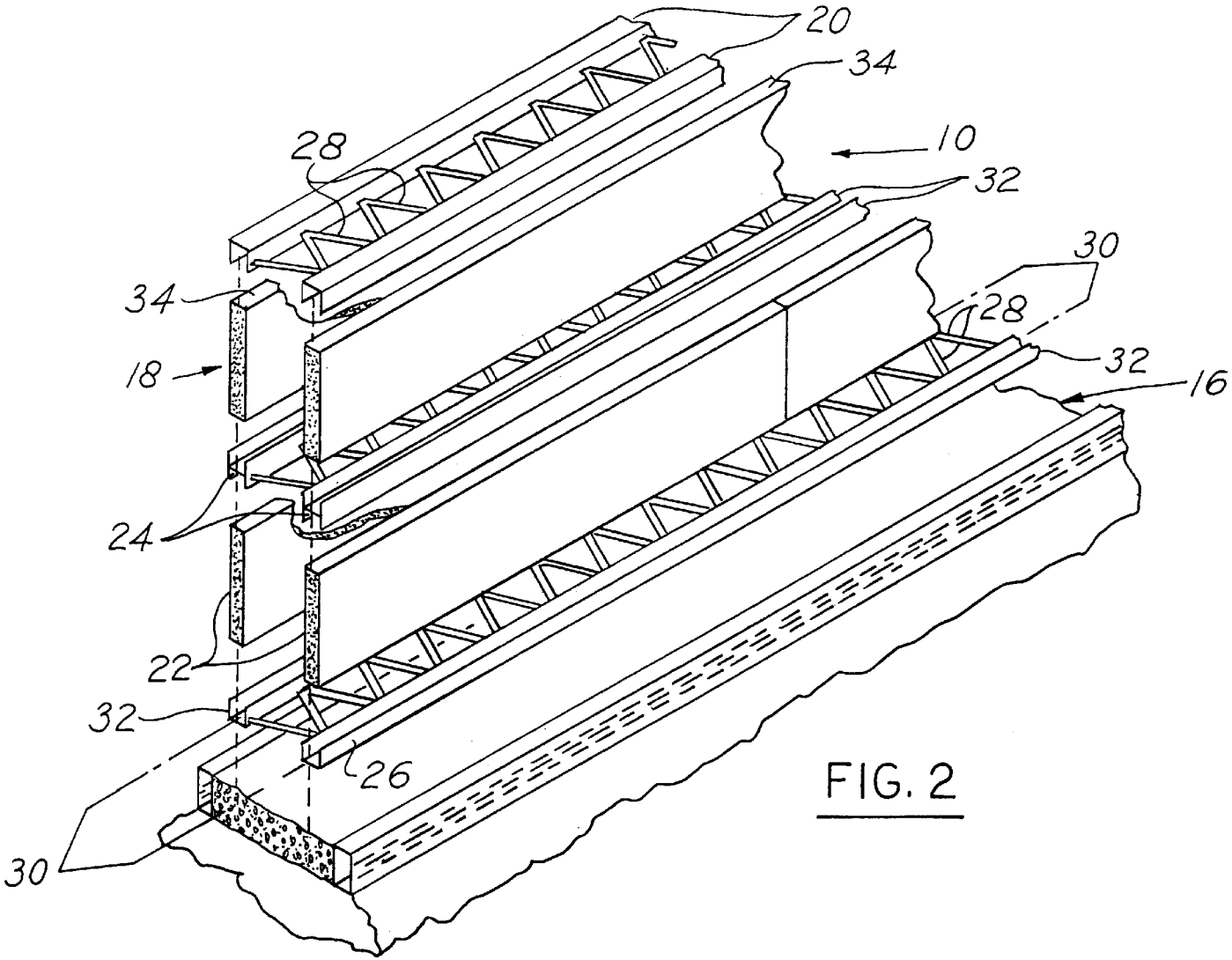
FIG. 2 is an exploded perspective view of the form system and apparatus shown in FIG. 1.

Referring to the drawings, a building form system and apparatus is shown in FIG. 1 at 10. The form system and apparatus is useful in construction and provides a form or mold for retaining concrete or other similar building materials until they harden to form a structural panel, foundation or the like. The form system 10 provides two spaced parallel panels 12 between which concrete can be poured to form a structural member. In one illustrated embodiment, the form system 10 comprises a bottom assembly 14 set on a footing 16, a plurality of panel assemblies 18 stacked thereon, and a top cap 20 placed on the top of a stack of the panel assemblies 18 as shown in FIGS. 1 and 2. The panel assemblies 18 preferably include panels 22 formed of a rigid, lightweight, inexpensive material such as expanded or extruded polymer foam inserted into H-shaped elongated members 24 that allow stacking of the panels 22. The panels 22 and the components in which they are inserted preferably have substantially planar surfaces. This enables widely available polymer foam materials to be used for the panels 22. Furthermore, the components can be easily and inexpensively extruded due to this planar design.

Figure 3A:
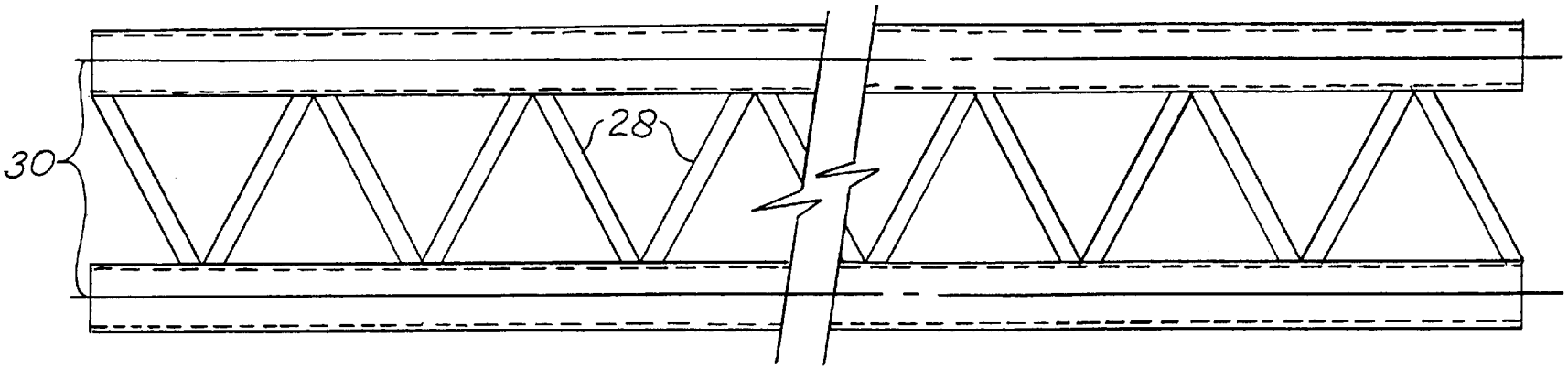
FIG. 3A is a bottom view of U-shaped bottom members connected by links.
Figure 3B:
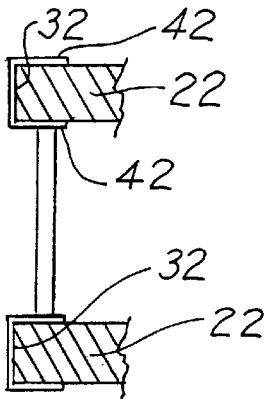
FIG. 3B is an end view of the members and links shown in FIG. 3A.
Figure 4A:
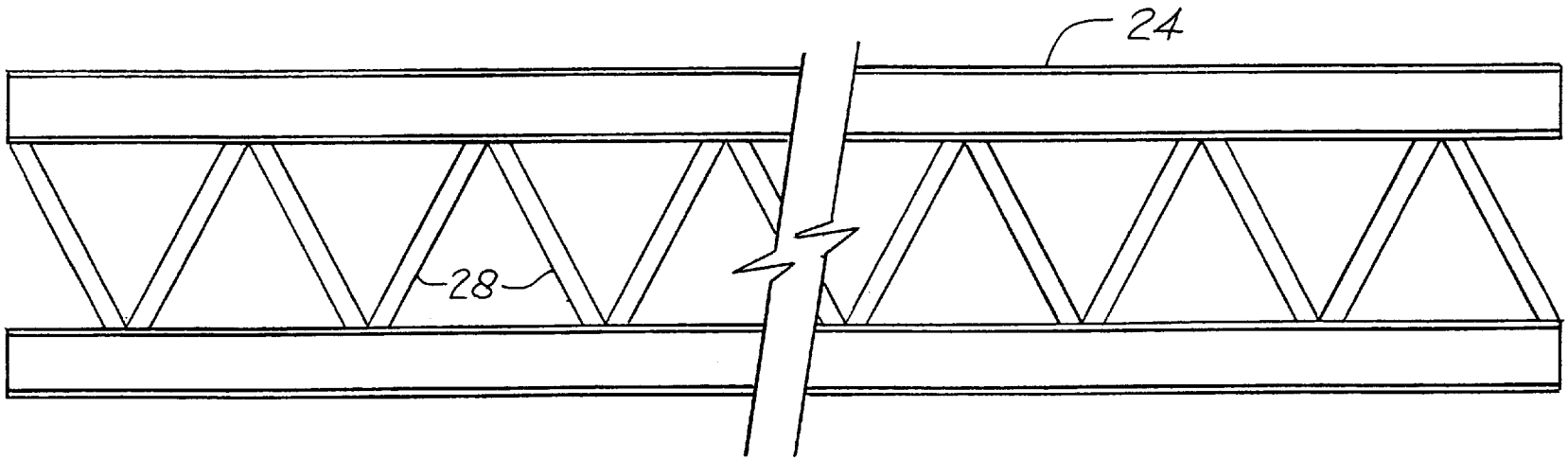
FIG. 4A is a top view of H-shaped members connected by links at acute angles.
Figure 4B:
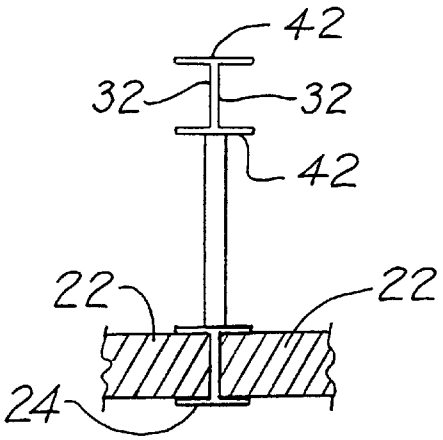
FIG. 4B is an end view of the members and links shown in FIG. 4A.
Figure 4C:
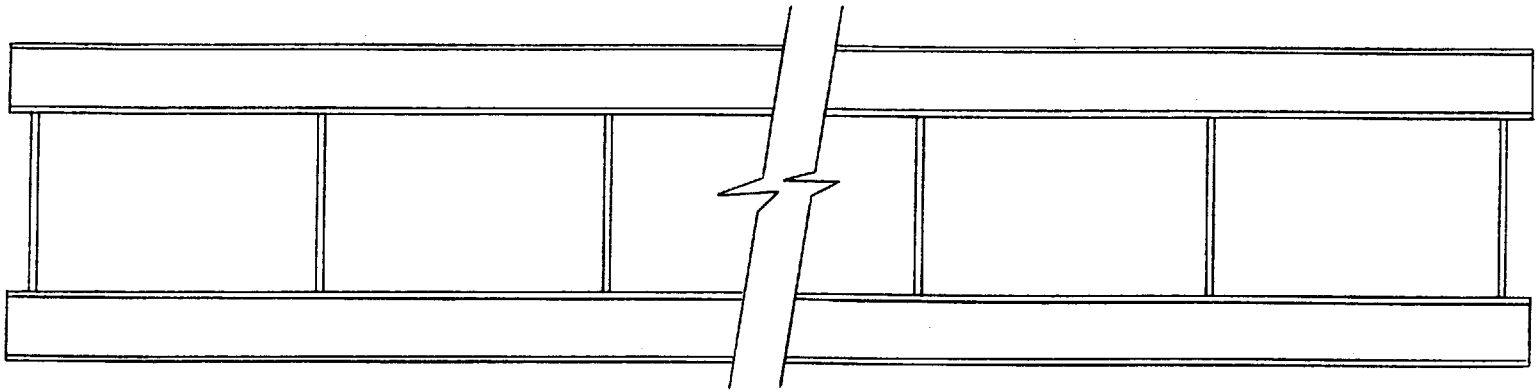
FIG. 4C is a top view of H-shaped members connected by links at ninety degree angles in accordance with a most preferred embodiment of the invention.
Figure 4D:
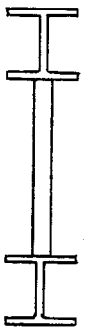
FIG. 4D is an end view of the members and links shown in FIG. 4C.

The bottom assembly 14 comprises two substantially U-shaped elongated members 26 connected by rigid links 28, as shown in FIGS. 2, 3A and 3B. In the most preferred embodiments, the top cap 20 is identical to the U-shaped elongated members 26. The links 28 are illustrated connected at acute angles along longitudinal axes 30 of the substantially U-shaped elongated members 26 as shown in FIG. 3A. However, the links 28 can be connected to the U-shaped elongated members 26, the H-shaped elongated members 24 (e.g., FIG. 4C) and top cap 29 at ninety degree angles which is a most highly preferred embodiment. The links 28 retain the panels 22 in a spaced-apart relationship to allow flow of the hardenable liquid building material (e.g., concrete) between the panels 22 and the U-shaped elongated members 26. Further, connecting the links 28 at ninety degree or acute angles prevents longitudinal shifting as well as compression or expansion of the spaced-apart relationship of the panels 22. This ensures the dimensional integrity of the resulting structure.

The panels 22 are received into channels 32 of the U-shaped elongated members 26 as shown in FIG. 1, 2 and 3B. While various dimensions can be used, it has been found that a depth of 1.5 inches and a width of 2.5 inches for the U-shaped elongated members 26 works satisfactorily. An exemplary spacing between the U-shaped elongated members 26 is 7.62 inches.

After the panels 22 are placed into the channels 32 of the U-shaped elongated members 26 coupled by the links 28, a substantially H-shaped elongated member 24 is placed on top of each of the panels 22 as shown in FIGS. 1, 2, 4A, 4B, 4C and 4D. Next, panels 22 are placed into the channels 32 of the H-shaped elongated members 24. It will be recognized that slots can be cut into the panels 22 into which portions (such as the flanges 42) of the H-shaped elongated members 24 and U-shaped elongated members 26 can be inserted. Stacking of the H-shaped elongated members 24 and the panels 22 can be repeated until a desired wall height is achieved as shown in FIG. 2. Further, the panels 22 can be easily cut to provide virtually any structure height desired. This is a distinct advantage over prior art systems which have typically required labor intensive operations to produce nonstandard structure heights.

Figure 5:
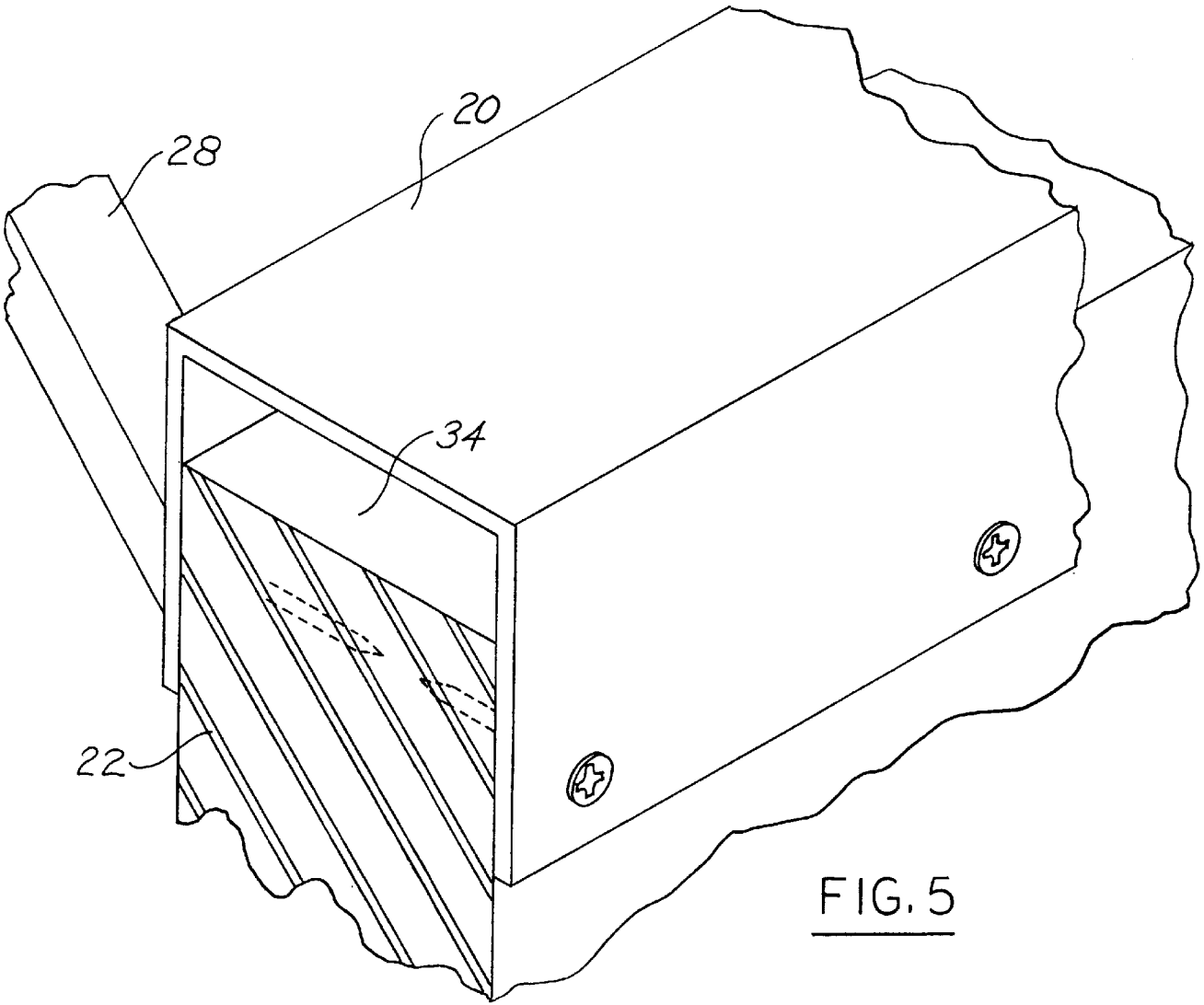
FIG. 5 is a perspective view of a top cap used to level the top of a panel structure formed by the invention.

A top cap 20 is placed over the upper edge 34 of the uppermost panel 22 as shown in FIGS. 2 and 5. If the upper edge 34 is not level, the top cap 20 can be fixed in place using drywall screws or other conventional means once it has been pivoted into a level configuration. In this way, the top surface of the resulting structure can quickly be made perfectly level, without requiring a complicated and labor-intensive process.

As shown in FIG. 1, the stacked panel assemblies 18 are braced on one side by a channel 36 connected to the panel assemblies 18 through use of drywall screws or other conventional means. The channel 36 is maintained in a desired configuration using a threaded steel rod mechanism 38 having a turnbuckle 40 disposed at its center. One end of the steel rod mechanism 38 is attached to the channel 36 and the other end of the steel rod mechanism 38 is connected to a post 42 driven into the ground. The panel assemblies 18 can be aligned at ninety degrees (plumb to the footing 16) by adjusting the post 42 and steel rod mechanism 38 accordingly.

Because the stacked panel assemblies 18 require bracing only on one side, workers never have to go outside the sections to work on the panel assemblies 18. This enables substantial reduction of the conventional four-foot working space which is typically dug outside foundation walls. With the present invention, this clearance space can be reduced to one foot or even less. Accordingly, much less backfilling is required. Ideally, backfilling is accomplished using sand so that drainage around the foundation is enhanced. However, using conventional systems requiring the four-foot working space, contractors often are reluctant to fill this entire space with sand due to the costs of such large quantities of sand. The substantially reduced backfilling far required by the present invention makes use of sand for backfilling far more cost effective.

The panel assemblies 18 are strong enough to allow the desired sand backfilling operations of the present invention to take place before concrete or other hardenable liquid building materials are poured into the system 10. This unusual strength enables greater flexibility in scheduling the backfilling operation, thereby expediting the construction process and lowering costs. Once all sections have been assembled and the top caps 20 have been leveled, hardenable liquid building material (preferably concrete) can be poured into the spaces between the top caps 20, panels 22, H-shaped elongated members 24 and the U-shaped elongated members 26. After the concrete hardens, a solid structure is formed. The invention allows drywall 27 or other building material to be connected to the panel assemblies 18 using drywall screws or other conventional means penetrating the flanges 42 of the H-shaped elongated members 24, U-shaped elongated members 26, as shown in FIG. 1. The drywall 27 can also be connected to the top cap 20 in an identical fashion.

While the members described herein can be formed from a variety of materials such as steel and plastic, preferably steel or extruded plastic are used depending on the availability and material cost of each in a specific region. The extruded plastic design allows relatively long members to be formed without expensive tooling required for injection molded designs. Even with these longer members, it may still be desirable to splice sections of assembled wall assemblies together as shown in FIGS. 6A–6C and 7.

Figure 6A:
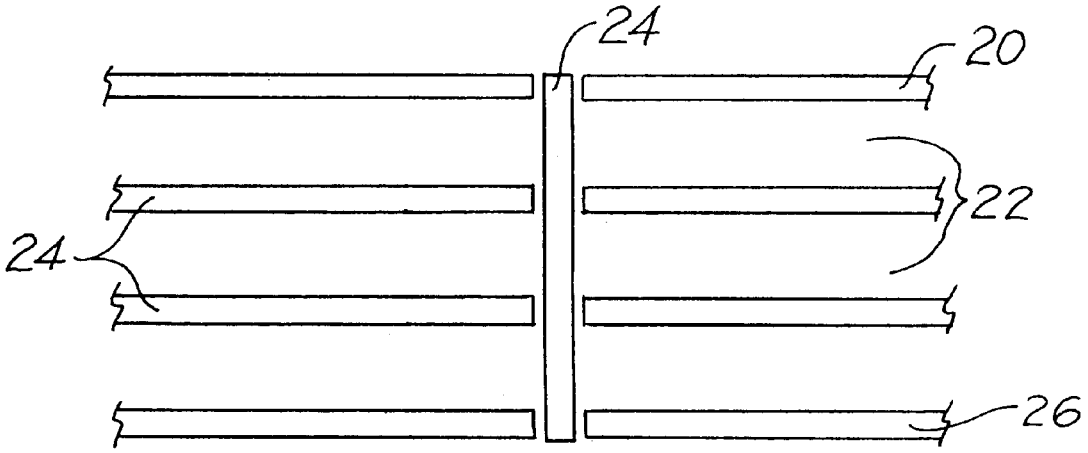
FIG. 6A is a side view of a section splice.
Figure 6B:
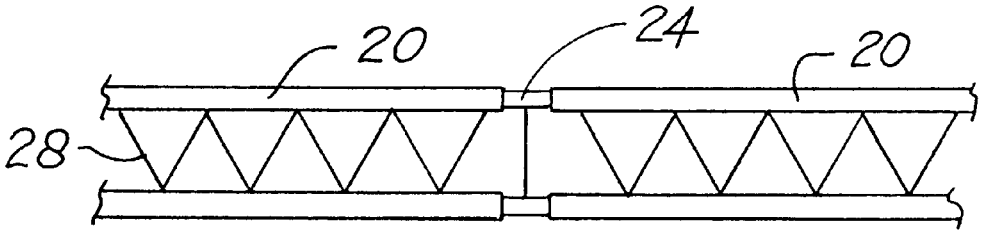
FIG. 6B is a top view of the splice shown in FIG. 6A.
Figure 6C:
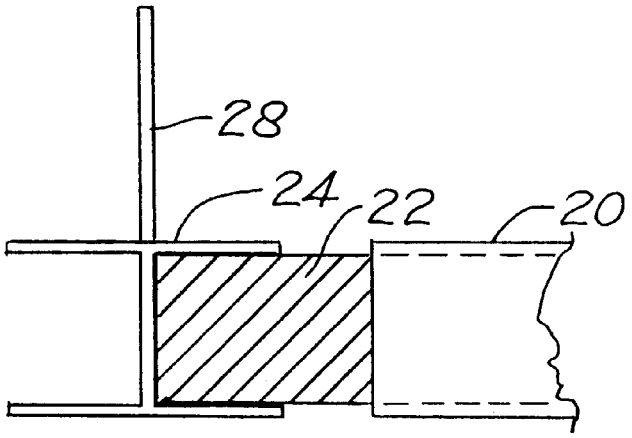
FIG. 6C is an enlarged sectional view of the splice shown in FIG. 6B.
Figure 7:
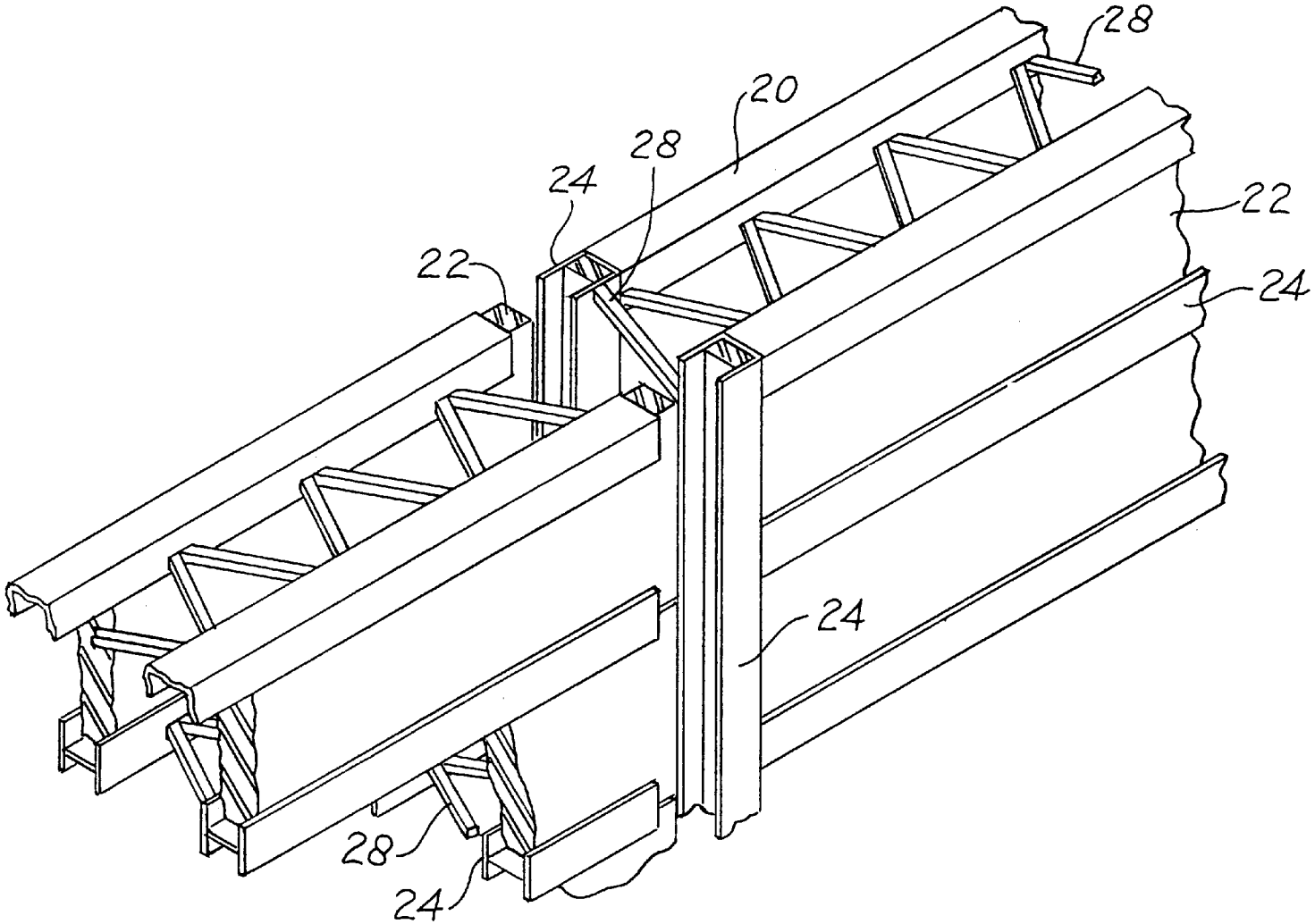
FIG. 7 is an enlarged and exploded perspective view of the splice (of two sections of assembled panel structures) shown in FIG. 6B.

The present invention does not require special, complex pieces for the splicing operation. Instead, an H-shaped elongated member 24 is placed vertically and abuts the H-shaped elongated members 24, the panels 22 and the U-shaped elongated members 26 from each section to be joined. The vertical H-shaped elongated member is connected to the various members using conventional means such as drywall screws. Next, the top cap 20 is placed over the assembled sections as shown in FIGS. 6C and 7. In this way, a secure connection is easily and quickly obtained.

Figure 8:
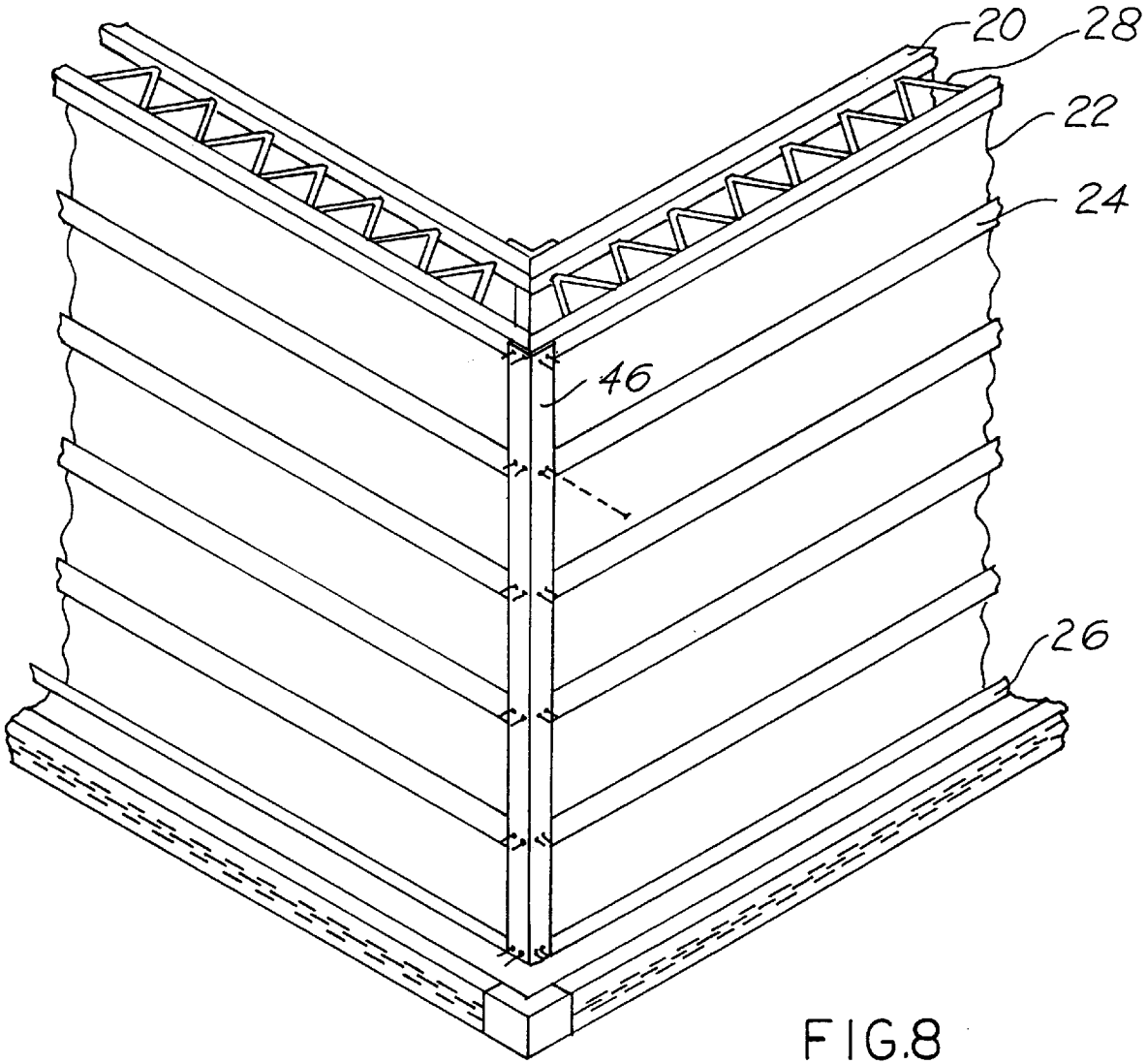
FIG. 8 is a perspective view of a ninety degree outside corner formed using one form of the present invention.

FIG. 8 shows a method of constructing a ninety degree outside corner. As illustrated, stacked assemblies are connected using two ninety degree angle pieces 46 connected to top caps 20, panels 22, H-shaped elongated members 24 and U-shaped elongated members 26 cut at forty-five degree angles. The angle pieces 46 are connected to the various members using conventional means such as drywall screws as shown in FIG. 8.

Figure 9:
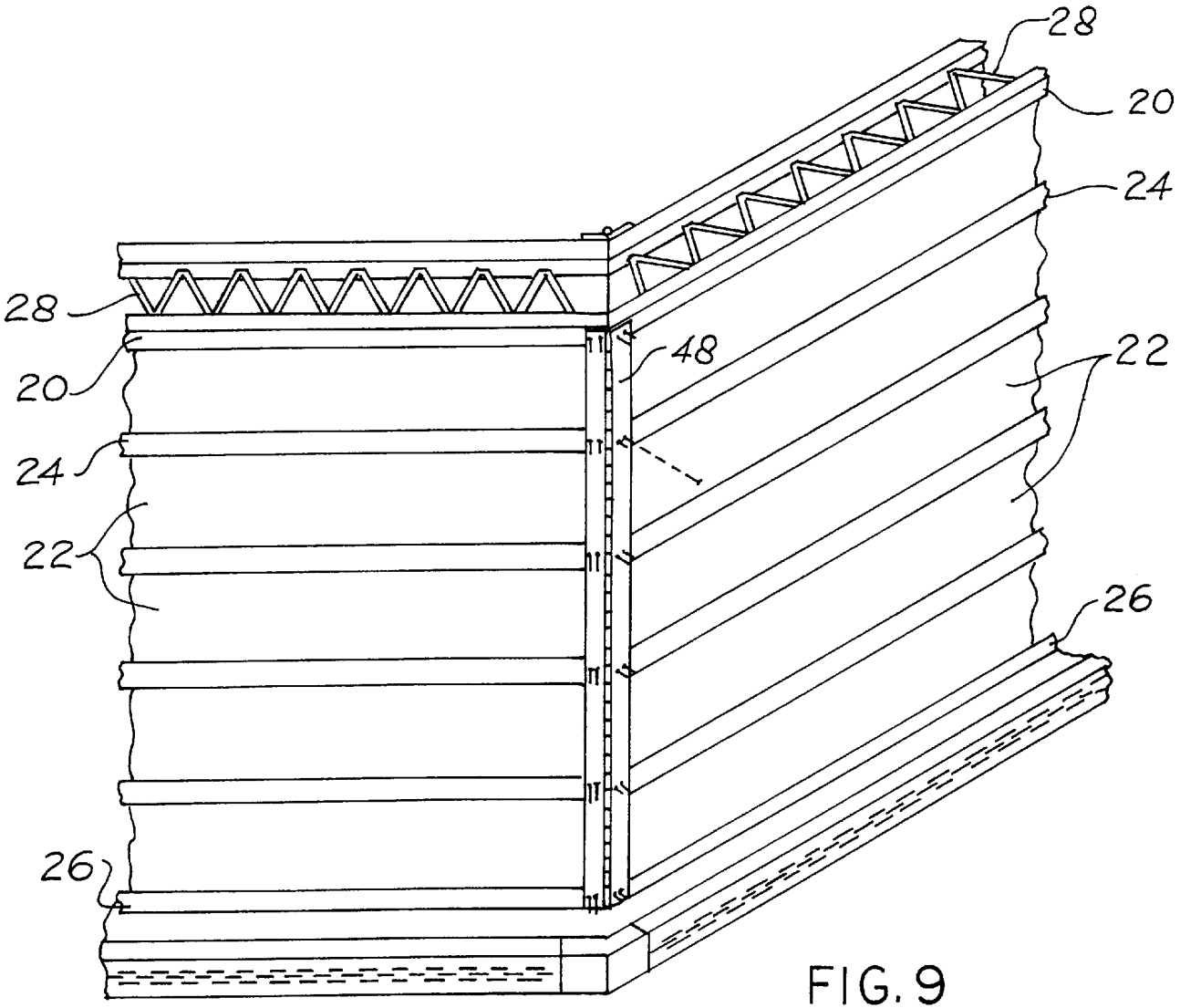
FIG. 9 is a perspective view of a forty-five degree outside corner formed in accordance with one form of the present invention.

FIG. 9 illustrates a forty-five degree outside corner constructed using one form of the present invention. In this case, the sections are cut at a twenty-two-and-one-half degree angle, and piano hinge members 48 are coupled to the sections to retain them in place.

Figure 10:
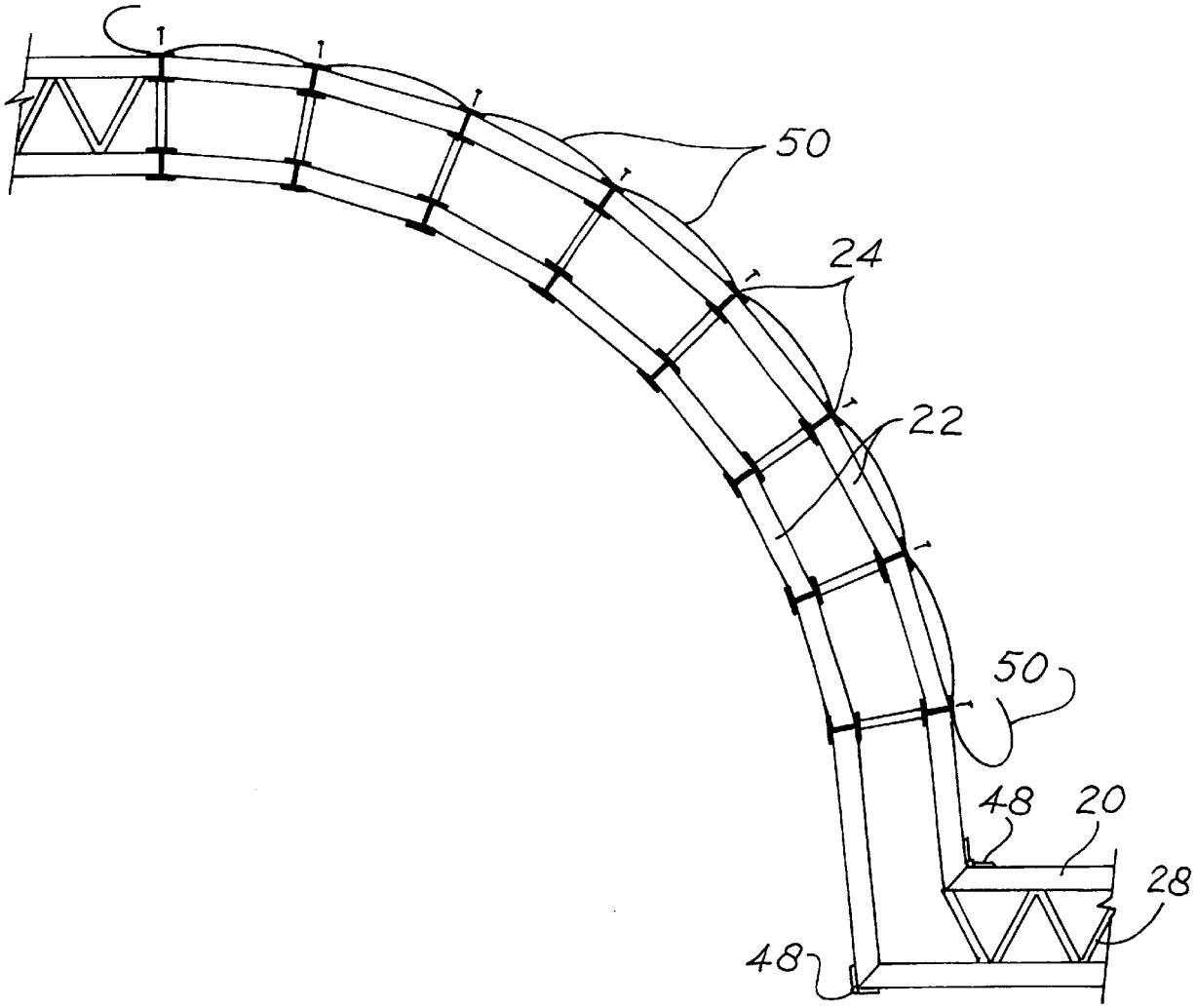
FIG. 10 is a top view of a wall form system for producing a curved panel.

The invention can also be used to form curved walls as shown in FIG. 10. In this embodiment, the beginning of the curved wall is connected to a standard section using piano hinge members 48 connected using conventional means such as drywall screws to a section abutting the curved section. The curved section comprises substantially H-shaped elongated members 24 in vertical orientation, similar to the splicing method described hereinbefore, along with narrower wall panels 22 for the inner portion of the curve section and wider panels 22 for the outer section. The entire assembly can be held together using conventional perforated metal strapping 50 or other conventional retention means as shown in FIG. 10.

Figure 11:
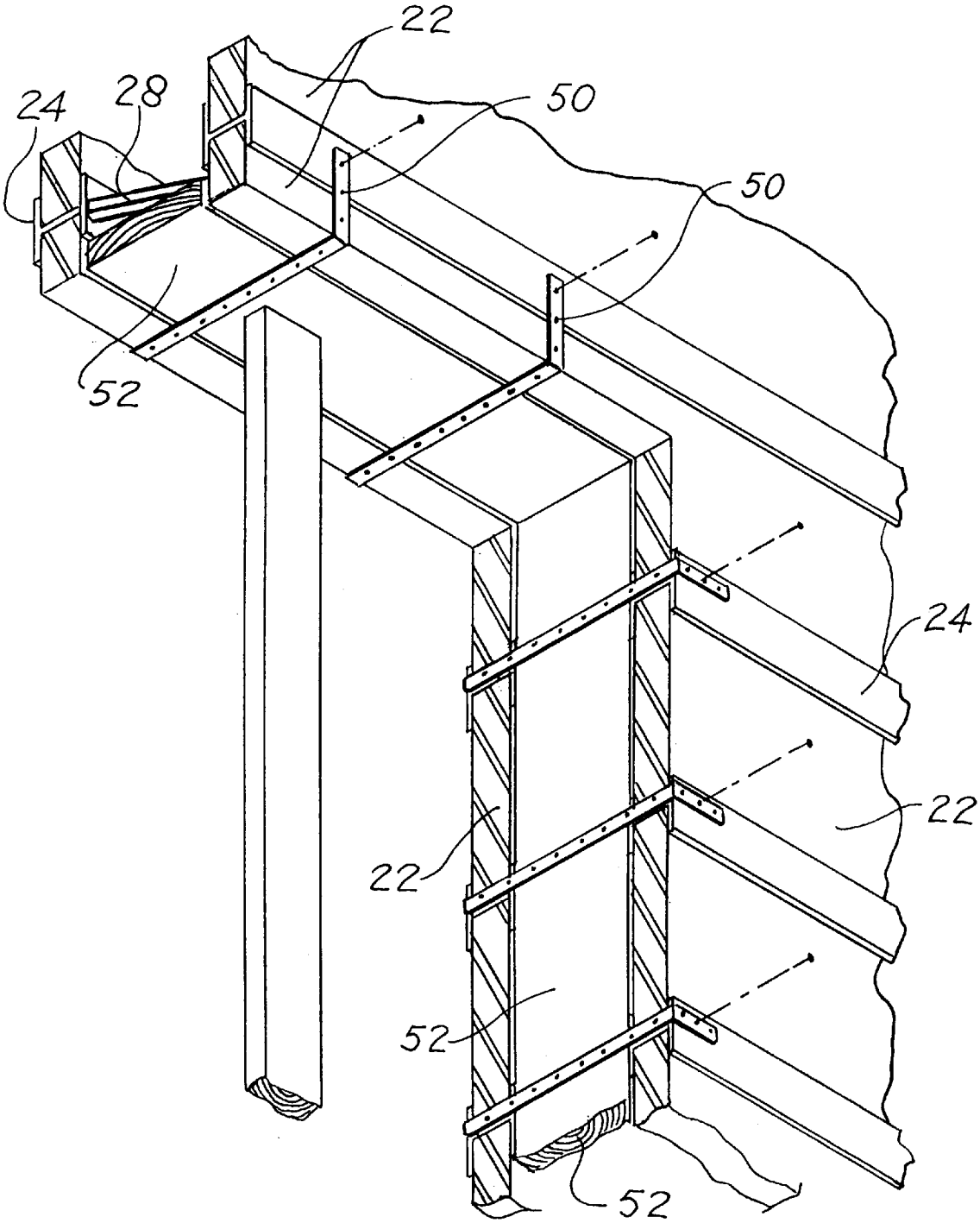
FIG. 11 is a perspective view of one form of the invention useful for framing a door or window opening.
Figure 12:
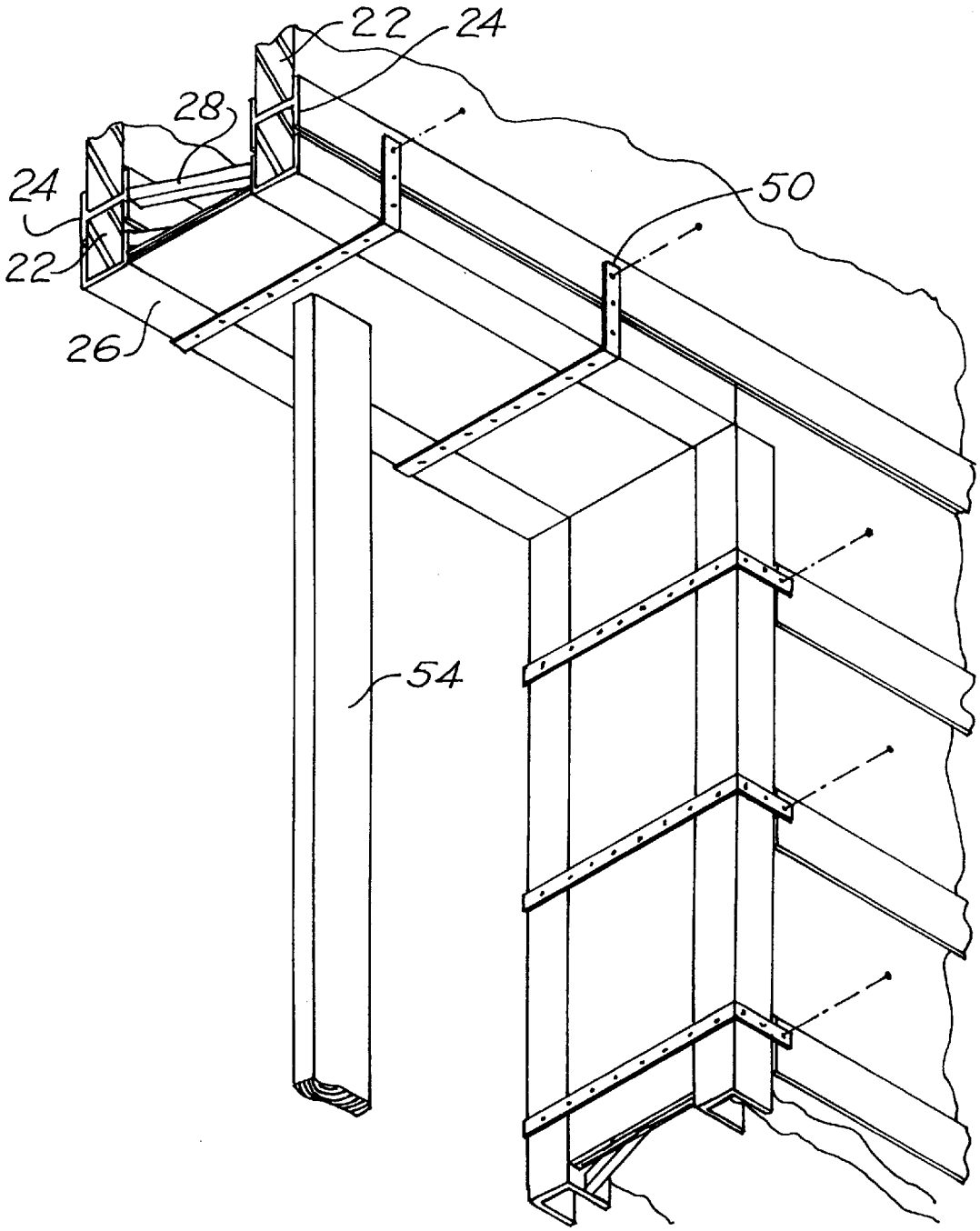
FIG. 12 is a perspective view of an alternative embodiment of one form of the invention useful for framing a door or window opening.
Figure 13:
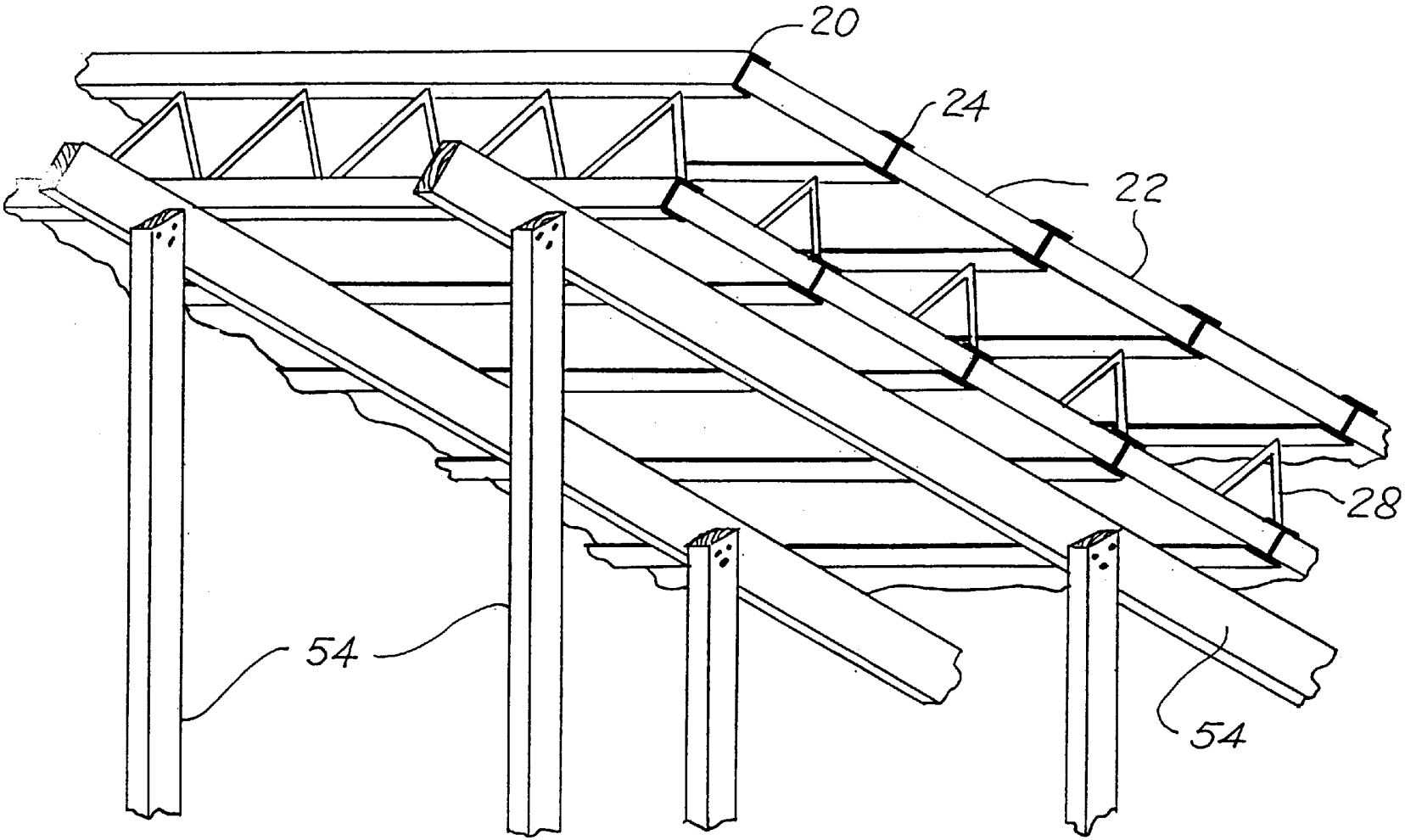
FIG. 13 is an end view of a roof application of one form of the invention.
Figure 14:
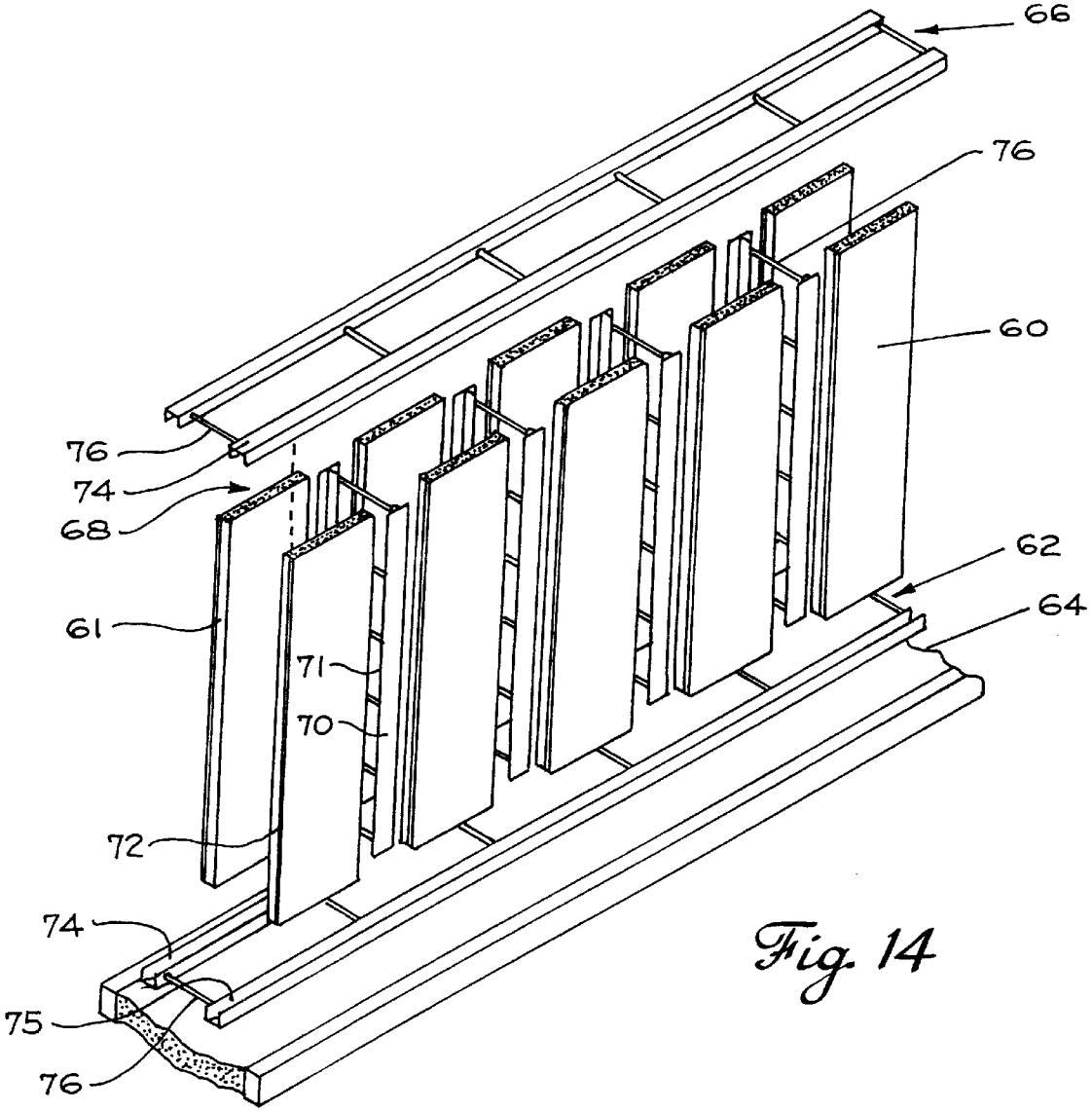
FIG. 14 is an exploded perspective view of a vertically oriented building form system and apparatus constructed in accordance with one form of the invention.

FIGS. 11–13 show alternative embodiments of the invention, wherein lumber 52 can be held in place by conventional metal perforated strapping 50 to form an end seal, or top or bottom seal for various sections as described hereinbefore. FIG. 13 illustrates how the form system 10 can be braced for forming sections other than those that are strictly vertical merely by using sufficient bracing 54 to hold the system in place. In this way, an entire building structure can be produced using the present invention.

Figure 15:
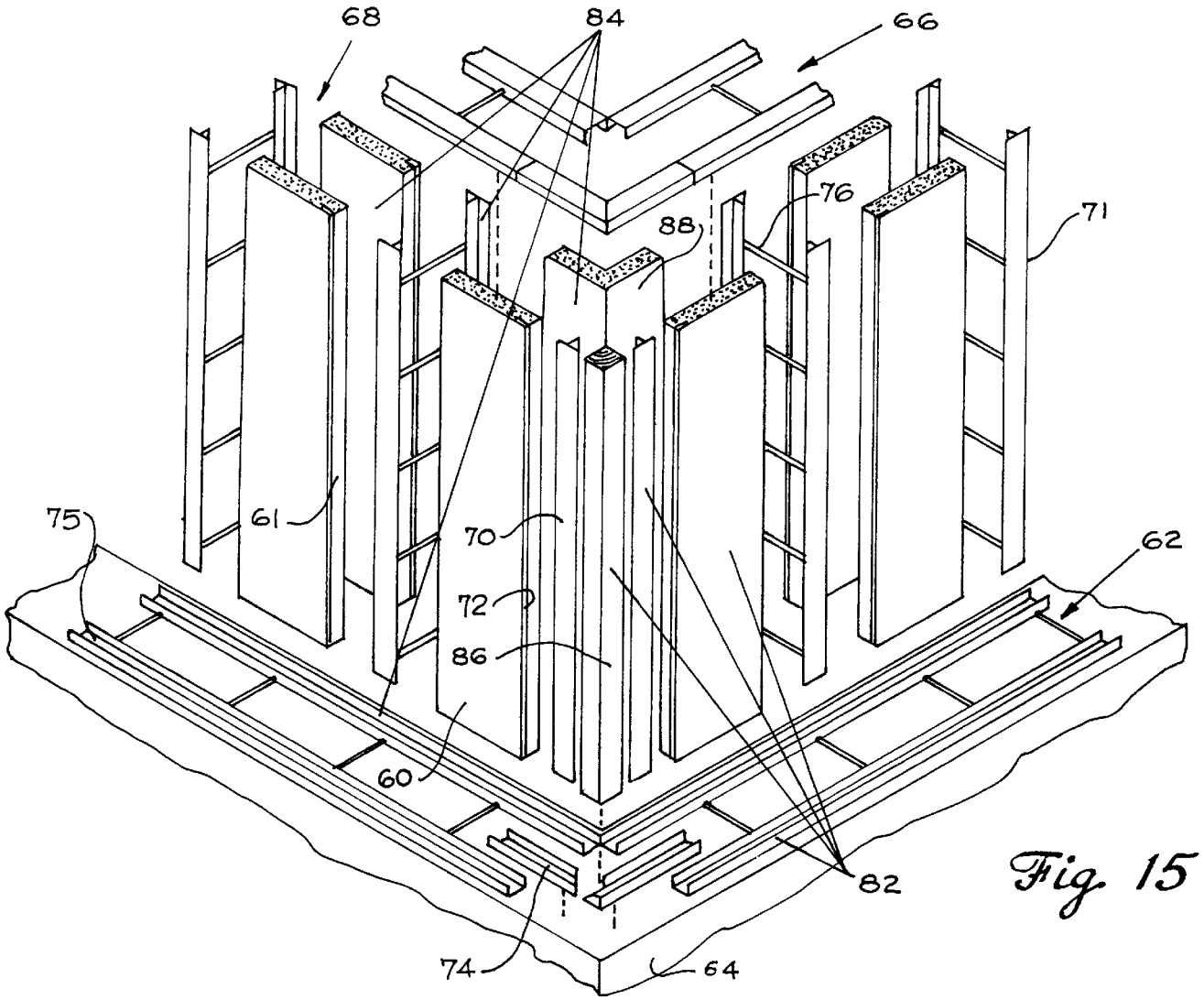
FIG. 15 is an exploded perspective view of a vertically oriented ninety degree outside corner assembly constructed in accordance with one form of the present invention.
Figure 16A:
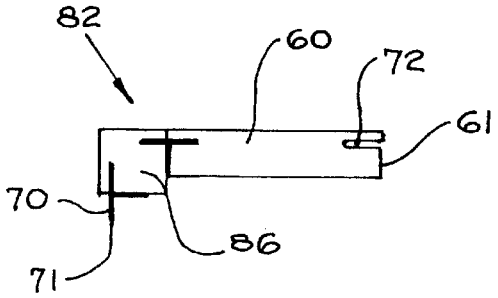
FIGS. 16A–16E illustrate top views of a method of constructing a ninety degree outside corner.
Figure 16B:
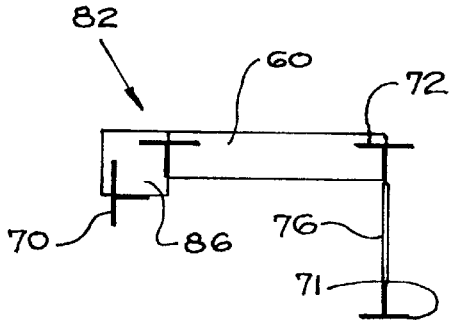
Figure 16C:
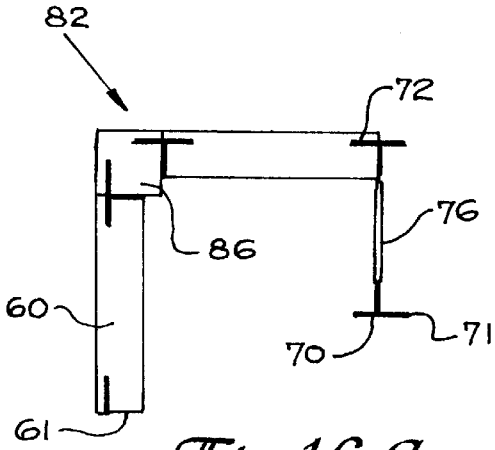
Figure 16D:
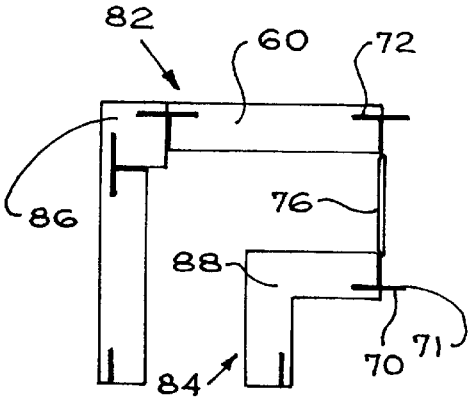
Figure 16E:
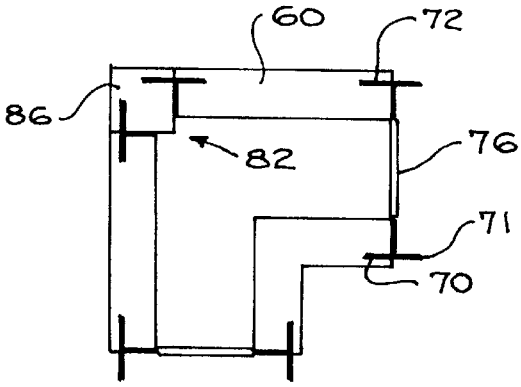
Figure 17A:
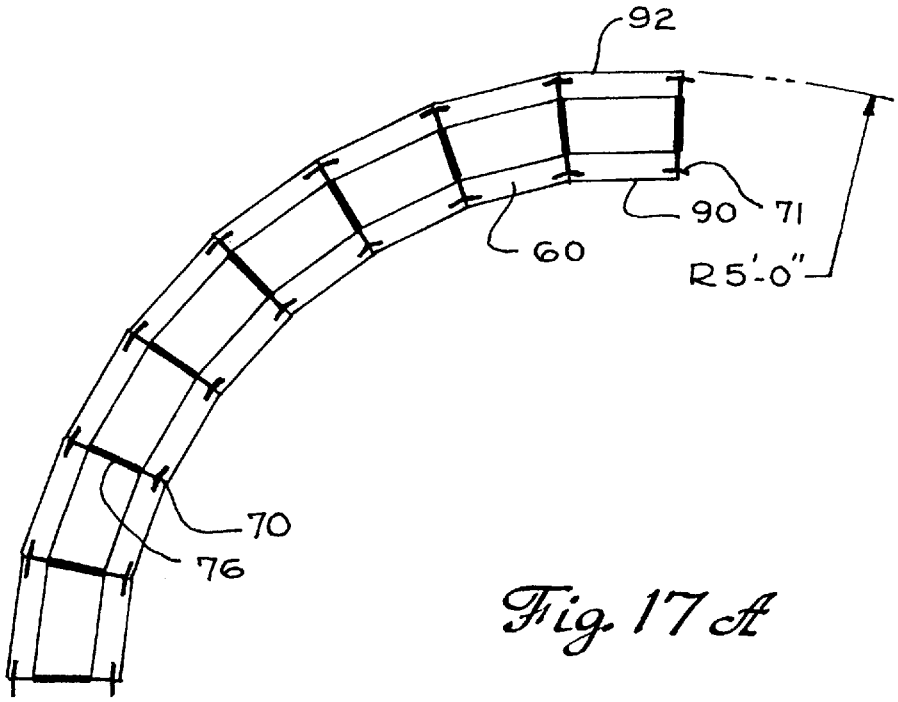
FIG. 17A is a top view of a vertically oriented building form system for producing a curved structure.
Figure 17B:
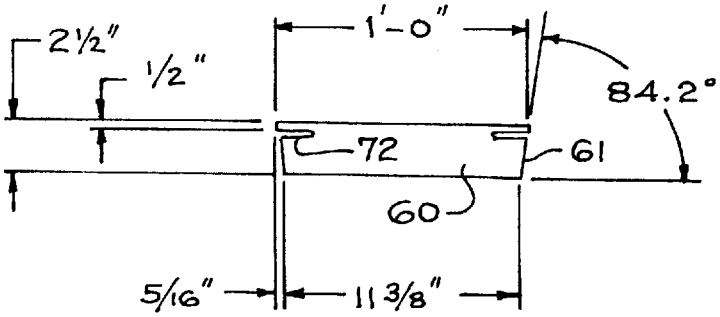
FIG. 17B shows a panel cut and beveled for use with the exterior alignment of the system represented in FIG. 17A.
Figure 17C:
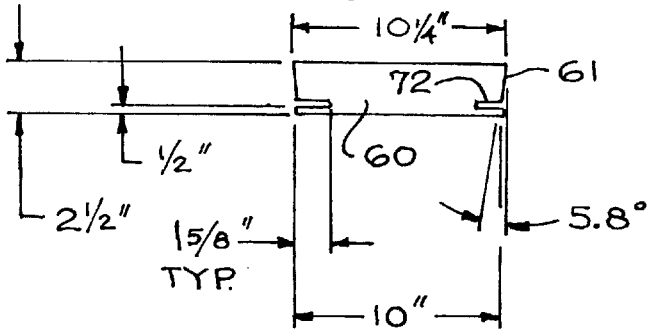
FIG. 17C shows a panel cut and beveled for interior alignment of the system illustrated in FIG. 17A.

A building form system and apparatus constructed in accordance with another preferred embodiment of the invention is shown in FIG. 15. The form system 10 provides two spaced, substantially parallel and substantially vertically oriented panels 60 between which concrete or other building material can be poured to form a structural member, in virtually the same manner as the curved wall construction shown in FIG. 10. The form system 10 preferably comprises a bottom assembly 62 set on a footing 64, a plurality of vertically oriented panels 60 aligned thereon, and a top cap 66 placed on the top of a line of panel assemblies 68 as shown in FIG. 15. The panel assemblies 68 preferably include panels 60 formed of a rigid, lightweight, inexpensive material such as expanded or extruded polymer foam connected by T-shaped elongated members 70 that can align the panels 60. The panels 60 can include one or more slots 72, sawn, milled or otherwise formed in the panel 60, such that a flange 71 of the T-shaped member 70 fits into the slot 72 in the lateral edge of the panel 60.

The bottom assembly 62 comprises two substantially U-shaped elongated members 74 connected by rigid links 76. In the most preferred embodiments, the top cap 66 is identical to the bottom assembly 62 but is installed in an inverted orientation. The links 76 can be connected at acute angles along the longitudinal axes of the substantially U-shaped elongated members 74. However, as illustrated, the links 70 are preferably connected to the U-shaped elongated members 74 and the T-shaped elongated members 70 at ninety degree angles. The links 76 retain the panels 60 in a spaced-apart relationship to allow flow of the hardenable liquid building material (e.g., concrete) between the panels 60 and the U-shaped elongated members 74. Further, connecting the links 76 at ninety degree or acute angles prevents longitudinal shifting as well as compression or expansion of the spaced-apart relationship of the panels 60. This ensures the dimensional integrity of the resulting structure.

After the panels 60 are placed into the channels of the U-shaped elongated members 74 coupled by the links 76, a substantially T-shaped elongated member 70 is placed into the slot 72 located on a lateral edge 61 of each of the panels 60 as shown in FIG. 15. The bottom edge of the T-shaped member 70 is placed into the channel 75 of the U-shaped member 74. The next panel 60 is aligned with the panel 60 already in place and attached to the panel 60 by inserting the flanges 71 of the T-shaped member 70 into the slot 72 in the lateral edge 61 of the panel 60. This construction method can be repeated, as shown in FIG. 15, until a desired structure length is achieved. Further, the panels 60 can be easily cut to provide virtually any structure height desired. This is a distinct advantage over prior art systems which have typically required labor-intensive operations to produce non-standard structure heights. The panels 60 can be easily raised and lowered along the tracks created by the flanges 71 of the T-shaped members 70 in order to install fixtures or other components between the interior and exterior panel assembles 86 as shown in FIG. 19.

The top cap 66 is placed over the top edge of the aligned panels 60 as shown in FIG. 15. If the aligned top edges are not level, the top cap 66 can be fixed in place using drywall screws or other conventional means once it has been pivoted into a level configuration. In this way, the top surface of the resulting structure can quickly be made perfectly level without requiring a complicated and labor-intensive process.

The building form system can be braced as shown in FIG. 19. Because the aligned panel assemblies 68 require bracing 80 only at the corners of the form system and the bracing 80 runs parallel to the form system, a significant amount of work effort and material is saved compared to prior art form systems which require vertical bracing at regular intervals to keep the panel assemblies 68 plumb and to prevent horizontal bulging. In addition, workers have limited functions to perform outside the panel assembly 68. This enables a substantial reduction in the conventional four-foot working space typically dug outside foundation walls. Accordingly, much less backfilling is required. The panel assemblies 68 are strong enough to allow the desired backfilling operations of the present invention to take place before concrete or other hardenable liquid building materials are poured into the system. This unusual strength enables greater flexibility in scheduling the backfilling operation, thereby expediting the construction process and lowering costs.

Once all sections have been assembled as shown in FIG. 15 and the top caps 66 have been leveled, hardenable liquid building material (preferably concrete) can be poured into the spaces between the top caps 66, panels 60, T-shaped elongated members 70 and the U-shaped elongated members 74. After the concrete hardens, a solid structure is formed. The invention allows drywall or other building material to be connected to the panel assemblies 68 using drywall screws or other conventional means penetrating the flanges of the T-shaped elongated members 70 or U-shaped elongated members 74. The drywall can also be connected to the top cap 66 in an identical fashion.

While the members described herein can be formed from a variety of materials such as steel and plastic, preferably steel or extruded plastic are used depending on the availability and material cost of each in a specific region. The extruded plastic design allows relatively long members to be formed without expensive tooling required for injection molded designs. Although vertical members are available in lengths of up to sixteen feet or more, it may still be desirable to splice sections of assembled wall assemblies together to create assemblies of greater height.

The present invention does not require special, complex pieces for the splicing operation. Instead, an H-shaped elongated member 24 can be placed horizontally across the top ends of the vertical panels 60 and T-shaped members 70. The horizontal H-shaped elongated member 24 is connected to the various members using conventional means such as drywall screws. The next level of vertically aligned panels 60 and T-shaped members 70 are inserted into the upwardly directed channel of the H-shaped member 24. Finally, the top cap 66 is placed over the assembled sections. In this way, a secure connection is easily and quickly obtained.

FIGS. 15 and 16A–16E show a method for constructing a ninety degree outside corner. U-shaped members 74 coupled by substantially rigid links 76 are cut at 45 degree angles at the ends and coupled to a footing 64 at a right angle to similar U-shaped members 74. To form the outer alignment of the corner assembly 82, the bottom edge of a corner post 86 is inserted in a substantially vertical orientation into the channel 75 of the outer U-shaped member 74. The bottom edge of a T-shaped member 70 in a substantially vertical orientation is inserted into the channel 75 of the outer U-shaped member 74 and the flange 71 of the T-shaped member is inserted into a slot in the lateral edge of the corner post 86. The bottom edge of a substantially vertically oriented panel 60 is inserted into the channel 75 of the outer U-shaped member 74 and the panel 60 is coupled to the corner post 86 by inserting the flange 71 of the T-shaped member 70 into a slot 72 in the lateral edge 61 of the panel 60. The corner post 86 preferably includes a built in drain tile to accept down spout run off from the roof of the structure and deliver it to a conventional tile in a foundation footing 64.

To form the inner alignment of the corner assembly 84, the bottom edge of a preformed panel 88 in the form of a ninety degree corner is inserted into the channel 75 of the inner U-shaped members 74. The bottom edge of a substantially vertically oriented T-shaped member 70, coupled to an opposite T-shaped member 70 by substantially rigid links 76, is inserted into the channel 75 of the inner U-shaped member 74 and the flange 71 of the T-shaped member is inserted into a slot in the lateral edge of the preformed panel 88. The bottom edge of a substantially vertical panel 60 is inserted into the channel 75 of the inner U-shaped member and coupled to the preformed panel 88 by inserting the flange 71 of the T-shaped member 70 into a slot 72 in the lateral edge 61 of the panel 60. Panels 60 and T-shaped members 70 alternately are inserted into the inner and outer U-shaped members 74 until a structure of the desired length is obtained.

Figure 18:
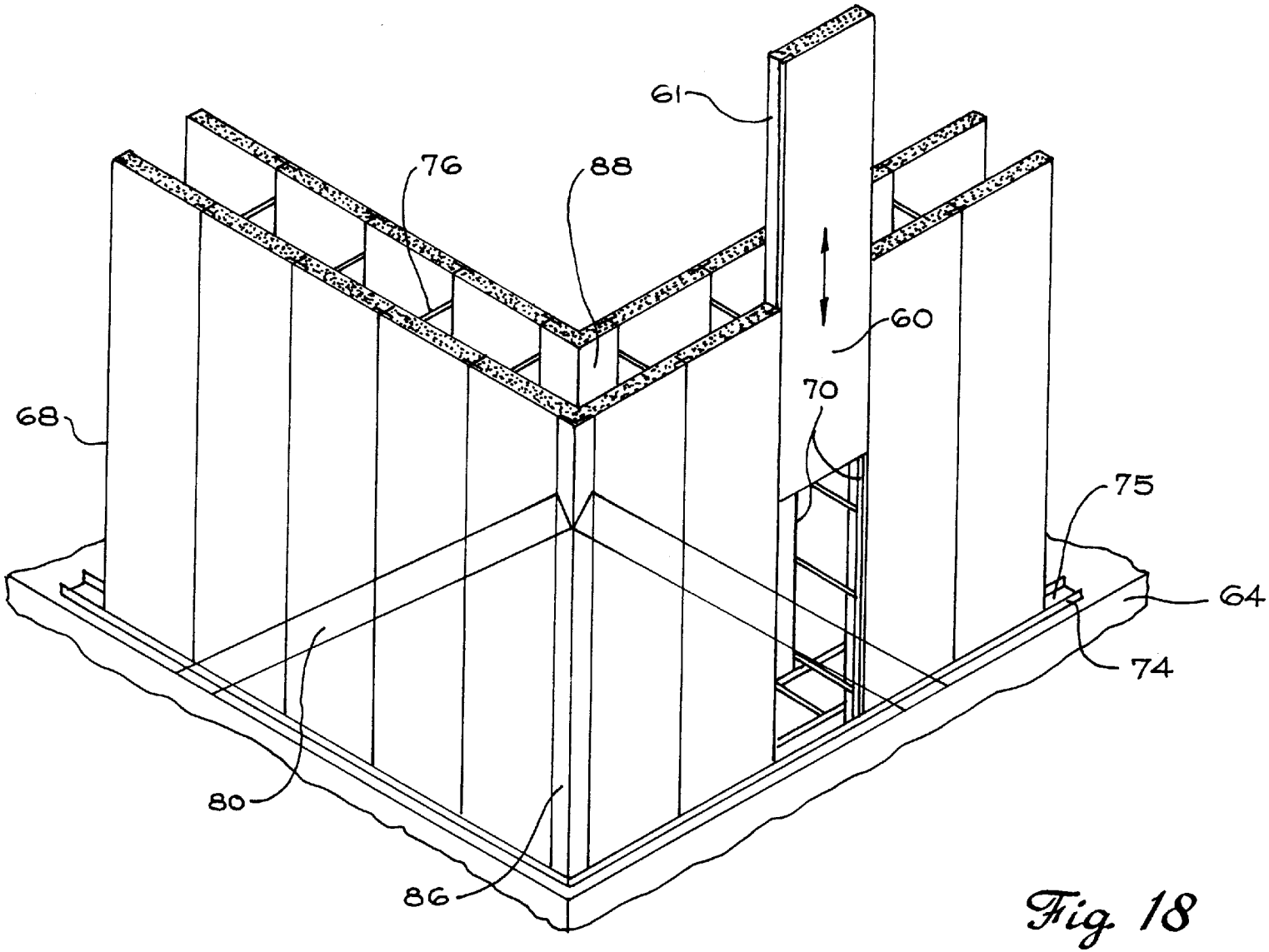
FIG. 18 is a perspective view of a vertically oriented building form system showing a method by which a panel can be raised and lowered prior to liquid building material being poured into the system.

The invention can also be used to form curved walls as shown in FIG. 18A. In this embodiment, the curved section comprises standard T-shaped elongated members 70 in a substantially vertical orientation. The T-shaped elongated members 70 are coupled by rigid links 76 that connect narrower panels 60 (as shown in FIG. 18C) in the inner arc of the curve 90 and wider panels 60 (as shown in FIG. 18B) in the outer arc of the curve 92. The panels 60 are beveled at an angle sufficient to allow the lateral edges 61 of said panels 60 to fit tightly together and prevent liquid building material leakage.

In another alternative embodiment of the invention, substantially vertically oriented H-shaped elongated members 24 are substituted for the T-shaped members 70. The bottom edge of the H-shaped member 24 is inserted into and contained within the channel of the U-shaped member 74. Alternatively, the panels 60 are aligned and connected by inserting the flanges of the H-shaped members 24 into slots in the lateral edges 61 of the panels 60 on either side of said member. In another embodiment, the panels are aligned and connected by inserting the lateral edges 61 of the panels 60 on either side of the H-shaped member 24 into the corresponding channel in the H-shaped member.

Accordingly, the present invention provides the ability to anchor drywall to the resulting structure. This is required by building codes in many areas of the country. Previous systems have typically not provided for this criterion, typically necessitating the use of masonry anchors which are expensive and time-consuming to install. The system of the present invention is simple to use, thereby reducing training costs and enhancing efficiency. Further, a smooth flat surface at the top of the form enables quick and easy clean up of concrete which spills over the side while pouring from conventional supply means such as a concrete truck. Because this spill over is very common, substantial labor savings can be realized by providing the easy to clean top surface of the present invention.

The invention provides a form system and apparatus that allows the upper surface of the resulting structure to be adjusted to level without complex and/or labor-intensive operations. The present invention also provides a form system and apparatus that utilizes simple corner components that are strong and easy to install and that requires no special pieces for connecting abutting pieces of the system to one another.

Further, the present invention provides the ability to level the top of a foundation, without requiring special pieces or cutting to attain a level upper surface of the foundation. It also provides a fully adjustable form system and apparatus that can be produced by extruding to increase the length of the components that can be produced over previous injection molded designs and reduces tooling and labor costs accordingly. Finally, the inventors have discovered that a form system and apparatus can be constructed to be strong enough to allow back filling operations to take place before concrete or other hardenable liquid building material is poured into the form. This enables easier access to the form for filing, and allows the back filling operation to be scheduled when time and weather permits. This flexibility of operation can further expedite the building process.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A method for constructing a forming system for building a corner structure having two non-coplanar surfaces connected to one another, the method comprising the steps of:

providing a first pair of substantially parallel U-shaped elongated members positioned upon a base;

providing a second pair of substantially parallel U-shaped elongated members positioned upon the base at an angle with respect to the first pair of members, the first and second pairs of members defining an outer channel and an inner channel;

inserting a first end of a corner element into the outer channel;

inserting a first end of a corner panel into the inner channel, the corner element and the corner panel each having lateral edges with substantially vertical slots defined therein;

inserting an outer panel into the outer channel on either side of the corner element;

inserting an inner panel into the inner channel on either side of the corner panel, the outer and inner panels each having lateral edges with substantially vertical slots defined therein;

providing a plurality of elongated members having flanges;

connecting the outer panels to the corner element by inserting the flanges of the elongated members into adjacent slots of the outer panels and the corner element;

connecting the inner panels to the corner panel by inserting the flanges of the elongated members into adjacent slots of the inner panels and the corner panel.

2. The method as claimed in claim 1, wherein the plurality of elongated members are T-shaped, with oppositely-extending flanges received within adjacent slots of the outer panels and corner element and within adjacent slots of the inner panels and corner panel.

3. The method as claimed in claim 2, wherein the elongated members connecting the outer panels and the corner element are connected to the elongated members connecting the inner panels and the corner panel via substantially rigid links.

4. The method as claimed in claim 1, wherein the plurality of elongated members are H-shaped.

5. The method as claimed in claim 4, wherein the elongated members connecting the outer panels and the corner element are connected to the elongated members connecting the inner panels and the corner panel via substantially rigid links.

6. The method as claimed in claim 1, wherein the U-shaped elongated members are connected together in pairs via substantially rigid links.

7. The method as claimed in claim 1, further comprising the steps of:

providing third and fourth pairs of substantially parallel U-shaped elongated members, the third and fourth pairs of members defining an outer channel and an inner channel;

inserting a second end of the corner element into the outer channel of the third and fourth pairs of members;

inserting a second end of the corner panel into the inner channel of the third and fourth pairs of members; and inserting the inner and outer panels into the inner and outer channels of the third and fourth pairs of members, respectively.

8. The method as claimed in claim 7, wherein the U-shaped elongated members of the third and fourth pairs of members are connected together in respective pairs via substantially rigid links.

9. The method as claimed in claim 1, wherein the corner element is a post.

10. The method as claimed in claim 1, wherein the corner panel is a panel having a longitudinal angle therein.

11. The method as claimed in claim 1, wherein the first pair of substantially parallel U-shaped elongated members is positioned upon the base at a substantially right angle with respect to the second pair of members, thereby defining a right-angled corner structure.

12. The method as claimed in claim 1, wherein the lateral edges of the inner and outer panels are beveled to orient adjacent panels in an angled relationship with respect to one another.

13. A method for constructing a corner forming system upon a base, comprising the steps of:

providing a substantially vertical corner structure having:

an inner channel define by at least one angled U-shaped elongated member;

an outer channel define by at least one angled U-shaped elongated member in substantially parallel relationship to the inner channel;

a substantially vertical inner corner element having a first end inserted within the inner channel, and lateral edges each having longitudinal grooves formed therein; and a substantially vertical outer corner element having a first end inserted within the outer channel, and lateral edges each having longitudinal grooves formed therein;

providing a plurality of flanged inner elongated members and flanged outer elongated members, each of the flanged inner an flanged outer elongated members having two flanges;

inserting a pair of inner panels into the inner channel on either side of the inner corner element, the inner panels each having lateral edges with longitudinal slots formed therein positioned adjacent to the longitudinal slots of the inner corner element, the inner panels being positioned in the inner channel in angled relationship to one another;

inserting a pair of outer panels to the outer channel on either side of the outer corner element, the outer panels each having lateral edges with longitudinal slots formed therein positioned adjacent to the longitudinal slots of the outer corner element, the outer panels being positioned in the outer channel in angled relationship to one another;

coupling the pair of inner pane s to the inner corner element via one of the plurality of flanged inner elongated members bet en each of the inner panels and the inner corner element, the flanges of the flanged inner elongated members extending within adjacent slots of the inner corner element and the inner panels;

coupling the pair of outer panels to the outer corner element via one of the plurality of flanged outer elongated members between each of the outer panels and the outer corner element, the flanges of the flanged outer elongated members extending within adjacent slots of the outer corner element and the outer panels.

14. The method as claimed in claim 13, wherein the flanged inner elongated members and the flanged outer elongated members are T-shaped.

15. The method as claimed in claim 14, wherein the flanged inner elongated members are substantially rigidly coupled to the flanged outer elongated members via links.

16. The method as claimed in claim 13, wherein the flanged inner elongated members and the flanged outer elongated members are H-shaped.

17. The method as claimed in claim 16, wherein the flanged inner elongated members are substantially rigidly coupled to the flanged outer elongated members via links.

18. The method as claimed in claim 13, further comprising the step of:

placing a top cap on top of the inner and outer corner elements, the inner and outer panels, and the plurality of flanged inner and outer elongated members.

19. The method as claimed in claim 18, wherein the top cap includes an, inner channel and an outer channel defined by two substantially parallel elongated U-shaped members.

20. The method as claimed in claim 13, wherein the two substantially parallel elongated U-shaped members are joined together by substantially rigid links.

21. The method as claimed in claim 13, wherein the inner corner element is L-shaped to define an angle between the inner panels within the inner channel.

22. The method as claimed in claim 13, wherein the outer corner element is a post.

23. The method as claimed in claim 21, wherein the outer corner element is a post.

24. The method as claimed in claim 13, wherein the inner panels are oriented in the inner channel on either side of the inner corner element at a substantially right angle with respect to one another, and wherein the outer panels are oriented in the outer channel on either side of the outer corner element at a substantially right angle with respect to one another.

25. The method as claimed in claim 13, wherein the lateral edges of the inner panels and the lateral edges of the outer panels are beveled to establish an angled orientation between each panel and adjacent panels inserted within the inner and outer channels.

26. A method of constructing a corner forming system, comprising the steps of:

providing a first pair of substantially parallel U-shaped channels defining an inner channel and an outer channel;

providing a second pair of substantially parallel U-shaped channels oriented at an angle with respect to the first pair of channel and further defining the inner channel and the outer channel;

inserting an inside corner element into the inner channel;

inserting an outside corner element into the outside channel;

inserting a pair of inner panels into the inner channel flanking the inside corner element;

inserting a pair of outer panels into the outside channel flanking the outside corner element;

coupling a flanged inner elongated connecting member to and between each inner panel and the inside corner element to couple the inner panels to the inside corner element; and coupling a flanged outer elongated connecting member to and between each outside panel and the outside corner element to couple the outside panels to the outside corner element.

27. The method as claimed in claim 26, wherein the step of coupling a flanged inner elongated connecting member to and between each inner panel and the inside corner element includes the step of inserting flange of each flanged inner elongated connecting member into a respective slot in the inside corner element.

28. The method as claimed in claim 27, wherein the step of coupling a flanged outer elongated connecting member to and between each outer panel and the outside corner element includes the step of inserting a flange of each flanged outer elongated connecting member into a respective slot in the out side corner element.

29. The method as claimed in claim 26, wherein the step of coupling a flanged outer elongated connecting member to and between each outer panel and the inside corner element includes the step of inserting flange of each flanged outer elongated connecting member into a respective slot in the ou side corner element.

30. The method as claimed in claim 26, wherein the step of coupling a flanged outer elongated connecting member to and between each outer panel and the outside corner element further includes the step of inserting a flange of each flanged outer elongated connecting member into a slot in an adjacent outer panel.

31. The method as claimed in claim 30, wherein the step of coupling a flanged inner elongated connecting member to and between each inner panel and the inside corner element further includes the step of inserting a flange of each flanged inner elongated connecting member into a slot in an adjacent inner panel.

32. The method as claimed in claim 26, wherein the step of coupling a flanged inner elongated connecting member to and between each inner panel and the inside corner member further includes the step of inserting a flange of each flanged inner elongated connecting member into a slot in an adjacent inner panel.

33. The method as claimed in claim 26, wherein the inner and outer elongated connecting members are T-shaped.

34. The method as claimed in claim 26, wherein the inner and outer elongated connecting member are H-shaped.

35. The method as claimed in claim 26, wherein the inner elongated connecting members are coupled to the outer elongated connecting members via substantially rigid links.

36. The method as claimed in claim 26, wherein each pair of substantially parallel U-shaped channels is coupled together via substantially rigid links.

37. The method as claimed in claim 26, wherein the angle between the first and second pairs of channels a substantially right angle.

* * * * *